US006796105B2

(12) United States Patent
Rossi

(10) Patent No.: US 6,796,105 B2
(45) Date of Patent: Sep. 28, 2004

(54) APPARATUS FOR WRAPPING GROUPS OF PRODUCTS

(75) Inventor: Bruno Rossi, Rimini (IT)

(73) Assignee: Robopac S.A., Falciano (SM)

( * ) Notice: Subject to any disclaimer, the term of this patent is extended or adjusted under 35 U.S.C. 154(b) by 0 days.

(21) Appl. No.: 10/294,421

(22) Filed: Nov. 14, 2002

(65) Prior Publication Data

US 2003/0093974 A1 May 22, 2003

(30) Foreign Application Priority Data

Nov. 22, 2001 (IT) ..... BO2001A0710

(51) Int. Cl.[7] ..... B65B 11/04

(52) U.S. Cl. ..... 53/399; 53/441; 53/556; 53/587

(58) Field of Search ..... 53/389.3, 399, 53/441, 442, 556, 557, 587, 211

(56) References Cited

U.S. PATENT DOCUMENTS 4,204,377 A * 5/1980 Lancaster et al. ..... 53/399
4,271,657 A * 6/1981 Lancaster et al. ..... 53/441
4,432,185 A * 2/1984 Geisinger ..... 53/587
4,502,264 A * 3/1985 Flaherty ..... 53/556
4,619,102 A * 10/1986 Geisinger ..... 53/399
4,955,181 A * 9/1990 Casteel ..... 53/556
5,138,818 A * 8/1992 Humphrey ..... 53/587
5,168,691 A * 12/1992 Errani ..... 53/587
5,452,566 A * 9/1995 Benhamou et al. ..... 53/389.3
5,572,850 A * 11/1996 Lancaster et al. ..... 53/389.3
6,164,047 A * 12/2000 Rossi ..... 53/587
6,453,643 B1 * 9/2002 Buscherini et al. ..... 53/399

FOREIGN PATENT DOCUMENTS

WO WO 01/05661 A1 * 1/2001

* cited by examiner

*Primary Examiner*—Louis Huynh
(74) *Attorney, Agent, or Firm*—Fay, Sharpe, Fagan, Minnich & McKee, LLP

(57) ABSTRACT

An apparatus for wrapping groups of products with plastic film comprises: a platform that rotates about a vertical axis and supports a group of products which, as the platform rotates, are wrapped with the film to form a package; a reel, from which the film is unwound, which rotates about a vertical axis and which can move up and down in such a way as to wrap the group in height as the platform rotates; a unit for gripping and tearing the film mounted outside the profile of the platform and designed to intercept and grip at least one portion of the film located between the group and the reel (4) once the group has been wrapped, in such a way that, acting in conjunction with a partial rotation of the platform, it tears the film at that portion to form an end or trailing free edge of film torn off by the gripping and tearing unit. The apparatus further comprises means for sealing the trailing free edge, mounted close to the platform and synchronised with the gripping and tearing unit to stably affix the trailing free edge to the wrapped product group.

13 Claims, 4 Drawing Sheets

APPARATUS FOR WRAPPING GROUPS OF PRODUCTS

BACKGROUND OF THE INVENTION

The present invention relates in general to apparatus for wrapping groups of products and, in particular, to a semiautomatic apparatus for wrapping groups of products arranged on pallets suitable for transporting the products.

In the field of designing and constructing machines for wrapping palletised products, manufacturers have, over time, adopted two different constructional philosophies which have led to the definition of two different categories of machines, namely, fully automatic machines and semiautomatic machines.

Both these categories of machines have a similar basic structure comprising a platform for the pallet that supports the groups of products to be wrapped and a frame which is positioned at the side of the platform and on which a reel of wrapping film is mounted.

In the case of automatic machines, there are solutions where the platform rotates and the reel moves only vertically up and down in order to unwind the film so that it covers the entire group of products, or solutions where the platform is fixed and the reel moves up and down mounted on an arm that rotates around the group of products.

For semiautomatic machines, the first of the above solutions adopted for automatic machines is usually used, that is to say, the rotating platform and the film reel moving only vertically in both directions. The essential difference between the two categories of machines is that, in automatic machines, a number of operations required to start and end the wrapping cycle (for example, positioning the free end of the film close to the group of products, cutting the film after it has been unwound around the products, sealing the end of the film on the group of wrapped products, etc.) are performed by automatic devices without the direct action of an operator, whereas semiautomatic machines require an operator to enable these operations to be performed.

Obviously, this basic difference means that automatic machines are very expensive, used only for high productivity and at the top end of the market, while semiautomatic machines are economically better suited to companies with small to medium production levels.

In order to reduce the gap between these two categories of machines, the Applicant designed and constructed a semiautomatic machine where the film cutting operation is automated (see patent application WO 01/05661). In this solution, the machine comprises a film gripping and tearing unit mounted outside the profile of a platform. The gripping and tearing unit intercepts at least one portion of film of a certain width, located between the product group and the reel after the product group has been wrapped on the platform. Then, acting in conjunction with a partial rotation of the platform, the unit tears the film off the reel at the intercepted portion.

This unit, while it does not significantly affect the cost of the machine and leaves the structure and functions of current semiautomatic machines unchanged, constitutes a notable improvement in that it automatically performs two important operations, namely, cutting the film—this being accomplished by tearing the film as the platform rotates, while withholding the end of the film still attached to the reel—and then transferring the end of the film to a gripper mounted on the platform, thus preparing the machine for the next wrapping cycle.

Tests have shown, however, that the trailing end of the film, which is gathered up and narrowed as a result of the tearing operation and which, after being torn, forms part of the wrapping on the group of products, may remain loose and does not always adhere perfectly to the surface of the wrapping. This is due to the fact that the adhesive properties of the film are not by themselves always sufficient to hold the end of the film down against the rest of the wrapping wound around the products. As a result, subsequent handling of the pallet may cause the wrapping to slacken and come away from the products.

SUMMARY OF THE INVENTION

The present invention therefore has for an object to overcome the above mentioned disadvantage by providing a semiautomatic apparatus capable of completely and efficiently wrapping the group of products without changing basic machine structure.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
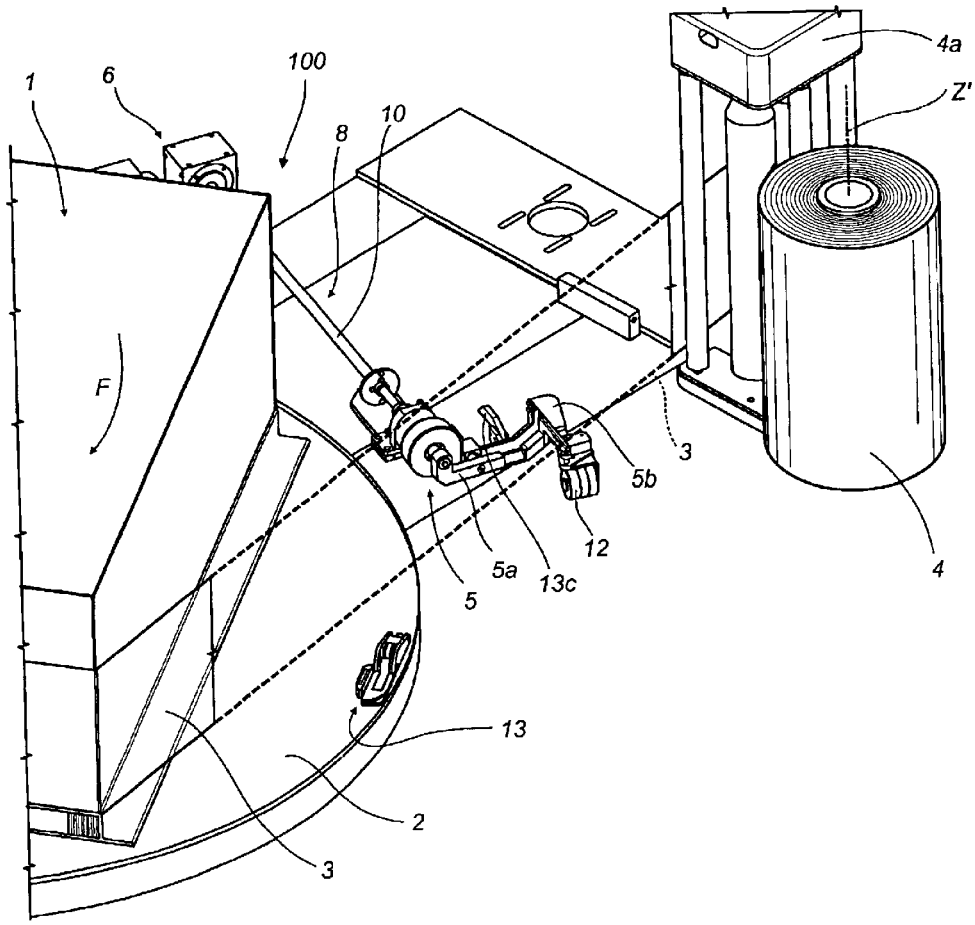
FIG. 1 is a perspective view, with some parts cut away in order to better illustrate others, of an apparatus for wrapping groups of products, made according to the present invention and illustrated in a first working position.
Figure 2:
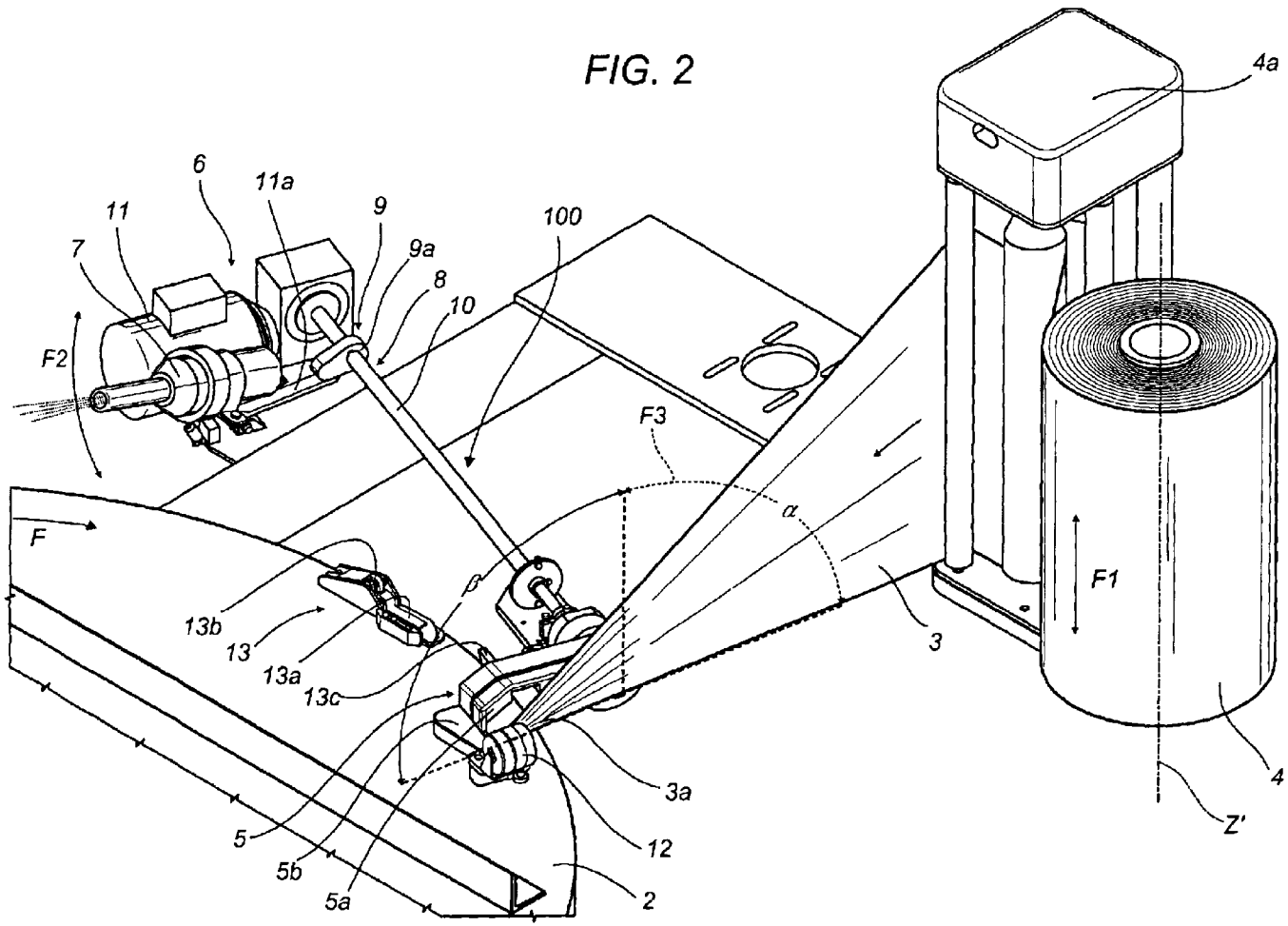
FIG. 2 is a perspective view, with some parts cut away in order to better illustrate others, of the apparatus of FIG. 1 in a second working position.
Figure 3:
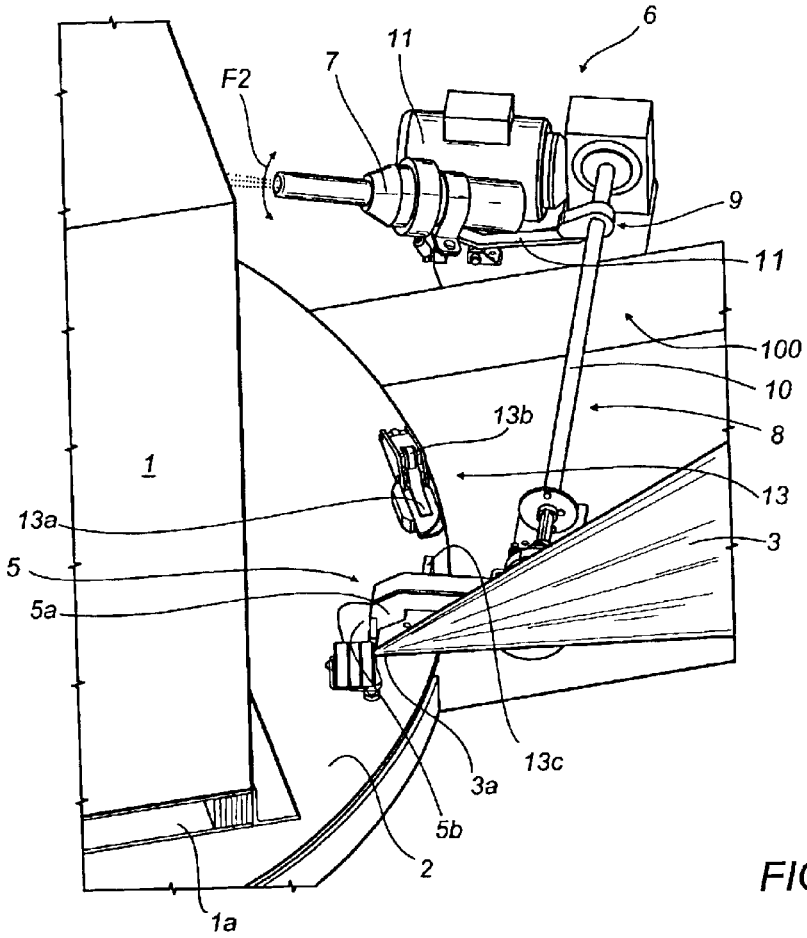
FIG. 3 is a perspective view of the apparatus of FIG. 2 in the second working position viewed from a different angle.

With reference to the accompanying drawings, and in particular FIGS. 1 to 3, the apparatus according to the invention is used to wrap products with plastic film, usually stretch film, the products being arranged in groups 1 on a pallet 1*a* for transportation.

The apparatus, labelled 100 in its entirety, essentially comprises a platform 2, a reel 4 and a unit 5 for gripping and tearing a plastic film 3.

More specifically, the platform 2 is of the type that is usually circular in shape, rotates about its vertical axis Z (see arrow F) and supports a group 1 of products which, as the platform 2 rotates, are wrapped with the plastic film 3 to form a package.

The reel 4, from which the film 3 is unwound, rotates about its vertical axis Z', and can move up and down (see arrow F1) on a mounting frame 4*a* in such a way as to wrap the group 1 in height as the platform 2 rotates.

Figure 4:
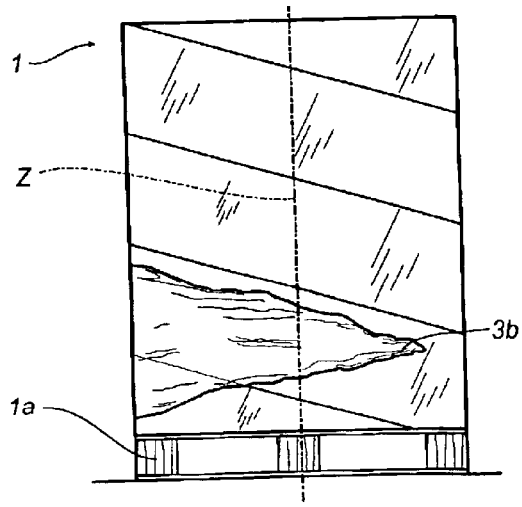
FIG. 4 is a front view of a group of products wrapped by the apparatus illustrated in the figures listed above.
Figure 5:
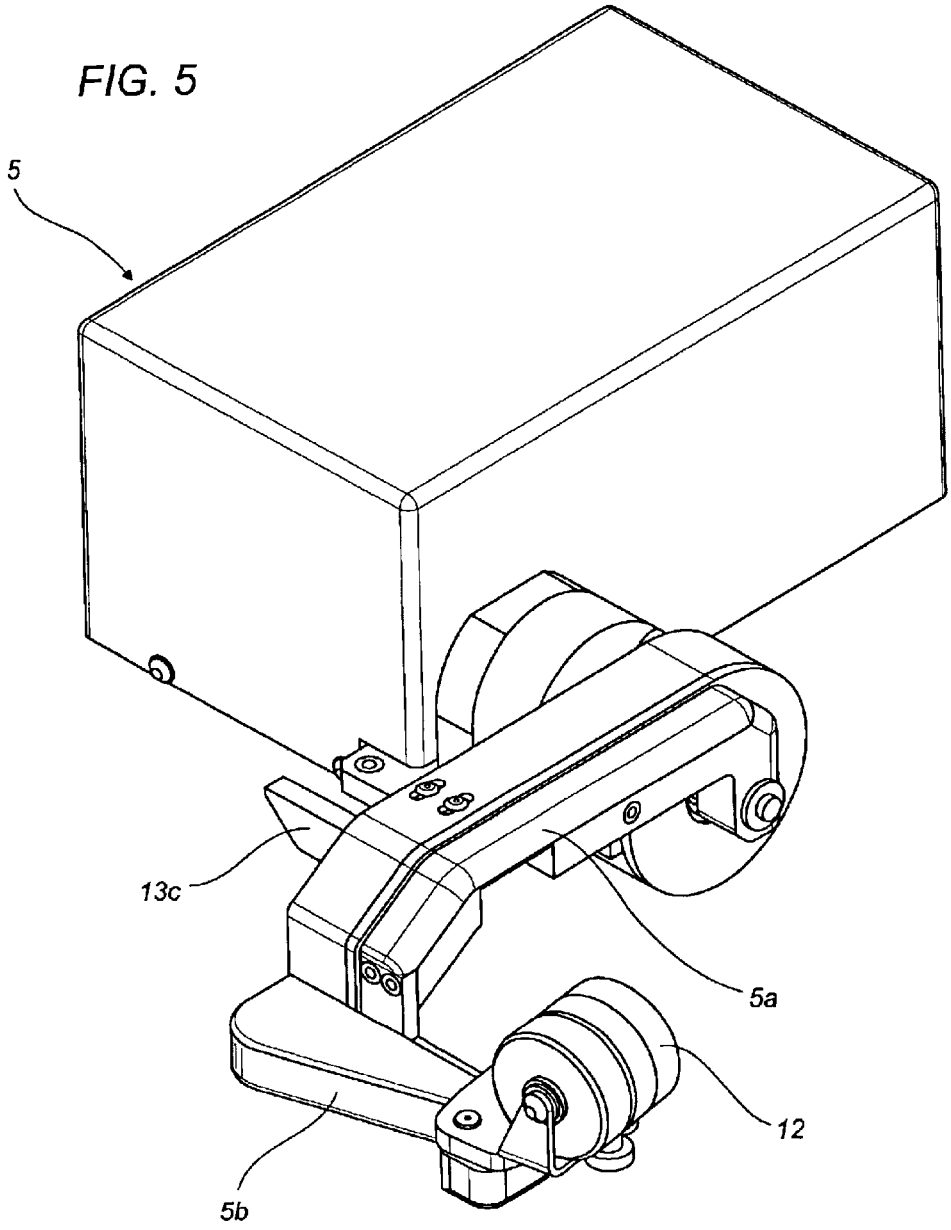
FIG. 5 is a perspective view, with some parts cut away in order to better illustrate others, of a part of the apparatus shown in the figures listed above.

The unit 5 for gripping and tearing the film 3 is mounted outside the profile of the platform 2 and, once the group 1 has been wrapped, moves upwards to a position where it intercepts and grips a portion of the film 3 located between the group 1 and the reel 4, and in such a way that, acting in conjunction with a partial rotation of the platform 2, it tears the film 3 at that portion. This creates two free edges of plastic film, a front or leading edge 3*a*, still attached to the reel 4, and an end or trailing edge 3*b* of film torn off (see FIG. 4) and forming part of the film 3 wrapped around the group 1.

As shown in FIGS. 1 to 3, the apparatus 100 comprises means 6 for sealing the free trailing edge 3*b*, mounted close to the platform 2 and working in conjunction and synchronised with the gripping and tearing unit 5 to stably affix the trailing free edge 3*b* to the wrapped product group 1.

More specifically, the sealing means 6 comprise heating means 7 working near the product group 1 of products and the trailing free edge 3*b*.

The sealing means 6 are mounted outside the profile of the platform 2 and are preferably connected by appropriate means 8 to the gripping and tearing unit 5.

More specifically, the sealing means 6 are connected to the gripping and tearing unit 5 and are equipped with cam means 9 which enable the sealing means 6 to be driven from a lowered, idle position to a raised, working position where they face the trailing free edge 3*b*.

Looking in more detail, the sealing means 6 include a hot air blower 7 mounted on a drive unit 8 consisting of a motor 11 and a drive shaft 10 which is also connected to and drives the gripping and tearing unit 5.

The drive shaft 10 mounts the cam means 9 that act on the blower 7 in such a way as to impart on the blower 7 a curved movement in both directions (see arrows F2) and thus enabling it to heat the trailing free edge 3*b* and a part of the film 3 wrapped around the product group 1 to attach the two parts of film and seal the product group 1.

The cam means 9 comprise a cam 9*a* keyed to the drive shaft 10 and in contact with a mounting plate 11 of the blower 7 so that the curved movement is performed when the gripping and tearing unit 5 has moved to a defined position.

The gripping and tearing unit 5 comprises an L-shaped arm 5*a* a portion 5*b* of which is transversal to the extension of the film 3 in the direction of the product group 1 and creates a well-defined area for gripping and tearing the film 3.

In addition to that, the portion 5*b* of the L-shaped arm is equipped at its free end with a separating roller 12 designed to facilitate correct feeding of the film 3 when the arm 5*a* is in the vertical position.

To better control the drive movement and the synchronisation between the gripping and tearing unit 5 and the blower 7, the operation of sealing the product group 1 comprises the following steps after the product group 1 has been completely wrapped and when the arm 5*a* has moved to a horizontal rest position outside the profile of the platform 2 (as shown in FIG. 2):

intercepting and gripping a portion of the film 3 located between the group 1 and the reel 4 from which the film 3 is being unwound, this step being performed by the gripping and tearing unit 5 as its arm 5*a* turns upwards through an angle α of approximately 90° relative to its previous rest position (see dashed line and arrow F3 n FIG. 2);

tearing the film 3 to form the above mentioned first and second leading and trailing edges 3*a* an 3*b*, at a point close to the area where the film 3 is gripped by the arm 5*a*, the tearing action being accomplished by partially rotating the platform 2 so as to pull the film between the product group 1 and the reel 4;

gathering the leading edge 3*a* of the film attached to the reel 4, by rotating the arm 5*a* through a further angle β of approximately 90° and positioning the leading edge 3*a* close to the edge of the platform 2;

heat sealing the trailing edge 3*b* of torn film to the wrapped product group 1, the sealing action being accomplished by the means 6 by lifting the blower 7 while the arm 5*a* is being lowered towards the platform 2.

More specifically, the sealing step is performed after further rotating the platform 2.

Once the trailing edge 3*b* has been sealed, the platform 2 continues to rotate so that the leading edge 3*a* of the film gathered by the arm 5*a* is pulled away and positioned on the platform 2 by catch means 13 consisting of a lever 13*a* equipped with a cam follower roller 13*b* actuated by a cam 13*c* attached to the bottom of the arm 5*a*.

The lever 13*a* receives the leading edge 3*a* from the arm 5*a* so that it is ready to start wrapping the next product group 1 on the platform 2.

An apparatus made as described above thus achieves the preset aims by the simple addition of a unit consisting of a blower driven by the same drive system as the gripping and tearing unit.

The fast acting blower rapidly softens and attaches the trailing edge 3*b* to the rest of the wrapping film 3 so as to effectively seal the package without necessitating any further operations.

The speed of the wrapping machine remains unchanged since the sealing step is completed just before the leading edge of the film is pulled away from the gripping and tearing unit and by the catch lever.

It will be understood that the invention can be subject to modifications and variations without thereby departing from the scope of the inventive concept. Moreover, all the details of the invention may be substituted by technically equivalent elements.

What is claimed is:

1. An apparatus for wrapping groups (1) of products with plastic film, the apparatus (100) comprising:

a platform (2) that rotates about a vertical axis (Z) and supports a group (1) of products which, as th platform (2) rotates, are wrapped with the film (3) to form a package;

a reel (4), from which the film (3) is unwound, which rotates about another vertical axis (Z') and which can move up and down in such a way as to wrap the group (1) in height as the platform (2) rotates;

a unit (5) for gripping and tearing the film (3) mounted outside a profile of the platform (2) and designed to intercept and grip a portion of the film (3) located between the group (1) and the reel (4) once the group (1) has been wrapped, in such a way that, acting in conjunction with a partial rotation of the platform (2), it tears the film (3) at that portion to form an end or trailing free edge (3*b*) of film torn off by the gripping and tearing unit (5); and means (6) for sealing the trailing free edge (3*b*), mounted close to the platform (2) and synchronised with the gripping and tearing unit (5) to stably affix the trailing free edge (3*b*) to the wrapped product group (1); said sealing means (6) are connected to the gripping and tearing unit (5) and are equipped with cam means (9) for moving said sealing means.

2. The apparatus according to claim 1, wherein the sealing means (6) comprise heating means (7) working near the product group (1) and the trailing free edge (3*b*).

3. The apparatus according to claim 1, wherein the sealing means (6) are mounted outside the profile of the platform (2).

4. The apparatus according to claim 1, wherein the sealing means (6) are connected by appropriate means (8) to the gripping and tearing unit (5).

5. The apparatus according to claim 1, wherein the sealing means (6) are driven, by said cam means (9), from a lowered, idle position to a raised, working position where they face the trailing free edge (3*b*).

6. The apparatus according to claim 1, wherein the sealing means (6) include a hot air blower (7) mounted on a drive unit 8) consisting of a motor (11) and a drive shaft (10) which is also connected to and drives the gripping and tearing unit (5); the drive shaft (10) mounting cam means (9) that act on the blower (7) in such a way as to impart on the blower (7) a curved movement in two directions and thus enabling it to heat at least the trailing free edge (3*b*) torn off and a part of the film (3) wrapped around the product group (1) to attach the trailing free edge (3*b*) torn off and the part of the film (3) wrapped around the product group (1) together.

7. The apparatus according to claim 6, wherein the cam means (9) comprise a cam (9*a*) keyed to the drive shaft (10) and in contact with a mounting plate (11) of the blower (7) so that the curved movement is performed when the gripping and tearing unit (5) has moved to a defined position.

8. The apparatus according to claim 1, wherein the gripping and tearing unit (5) comprises an L-shaped arm (5*a*) a portion (5*b*) of which is transversal to the extension of the film (3) in the direction of the product group (1) and creates a well-defined area for gripping and tearing the film (3).

9. The apparatus according to claim 8, wherein the portion (5*b*) of the L-shaped arm is equipped at its free end with a separating roller (12) designed to facilitate correct feeding of the film (3) when the arm (5*a*) is in the vertical position.

10. A method for wrapping groups (1) of products with plastic film (3), comprising the following steps:

intercepting and gripping a portion of the film (3), located between the group (1) and a reel (4) from which the film (3) is being unwound, by a gripping and tearing unit (5) mounted outside a profile of a rotating platform (2) that supports the products group (1);

tearing the film (3) to form a first leading edge (3*a*) and a second trailing edge (3*b*), at a point close to the area where the film (3) is gripped by the gripping and tearing unit (5), the tearing action being accomplished by partially rotating the platform (2) so as to pull the film between the product group (1) and the reel (4);

gathering the leading edge (3*a*) of the film attached to the reel (4), in such a way as to position the leading edge (3*a*) close to the edge of the platform (2), this being performed by the gripping and tearing unit (5);

pulling away the leading edge (3*a*) of the film, after it has been gathered by the gripping and tearing unit (5), by catch means (13) mounted on the platform (2); and attaching the second trailing edge (3*b*) of torn film to the wrapped products group (1) prior of pulling away the leading edge (3*a*) of film (3);

the step of attaching the trailing edge being performed by sealing means (6) connected to the gripping and tearing unit (5) and equipped with cam means (9) for moving said sealing means.

11. The method according to claim 10, wherein the step of sealing the second, trailing edge (3*b*) is performed hot.

12. The method according to claim 10, wherein the sealing step is performed after a further rotation of the platform (2).

13. An apparatus for wrapping a group of products with plastic film, the apparatus comprising:

a platform that rotates about a first vertical axis and that is adapted to support an associated group of products;

a film reel support adapted to support and vertically move an associated reel of wrapping film relative to said platform;

a film gripping and tearing unit mounted adjacent said platform; and a film sealing device mounted adjacent said platform, said sealing device operably associated with said film gripping and tearing unit through a cam that moves said sealing device in response to movement of said film gripping and tearing unit.

* * * * *